US005423104A

United States Patent [19]

West

[11] Patent Number: 5,423,104

[45] Date of Patent: Jun. 13, 1995

[54] FILM STRIP CLEANER APPARATUS

[75] Inventor: Charles R. West, Kansas City, Mo.

[73] Assignee: Systems & Products Engineering Co., Kansas City, Kans.

[21] Appl. No.: 77,017

[22] Filed: Jun. 15, 1993

[51] Int. Cl.[6] ..... G03C 11/06; B08B 1/02

[52] U.S. Cl. ..... 15/100; 15/97.1; 15/104.002

[58] Field of Search ..... 15/100, 88.3, 97.1; 352/130; 134/6, 9

[56] References Cited

U.S. PATENT DOCUMENTS

| | | | |
|---|---|---|---|
| 1,022,510 | 4/1912 | Seaborne | 15/100 |
| 1,189,633 | 7/1916 | Shue | 15/100 |
| 1,199,424 | 9/1916 | Robinson . | |
| 1,857,633 | 5/1932 | Gramsa . | |
| 2,791,788 | 5/1957 | Hausdorf | 15/100 |
| 3,609,020 | 9/1971 | Kelly . | |
| 3,778,139 | 12/1973 | Kelly . | |
| 4,211,580 | 7/1980 | Vowles . | |
| 4,637,088 | 1/1987 | Badaracco et al. | 15/100 |

*Primary Examiner*—Edward L. Roberts, Jr.
*Attorney, Agent, or Firm*—Litman, McMahon & Brown

[57] ABSTRACT

A film strip cleaner apparatus includes a support plate having a plurality of film guide rollers journaled thereon to define a cleaning path of the film. A cleaning roller carrying arm is pivotally mounted on the support plate and has a pair of spaced apart film cleaning rollers journaled thereon and positioned on opposite sides of the film cleaning path. A position lock pin is mounted on an end of the roller arm and is resiliently urged toward the support plate. A pair of pin receiving apertures are formed through the support plate and are positioned in angularly spaced relation to the pivot axis of the roller arm. A knob is connected to the lock pin to enable the pin to be withdrawn from the apertures to move the roller arm between an engaged or film cleaning position with the film cleaning rollers engaging opposite sides of the film in the cleaning path and a retracted position with the film cleaning rollers retracted away from the film to enable the cleaning rollers to be removed from the roller arm to restore their cleaning properties.

17 Claims, 2 Drawing Sheets

Fig. 3.
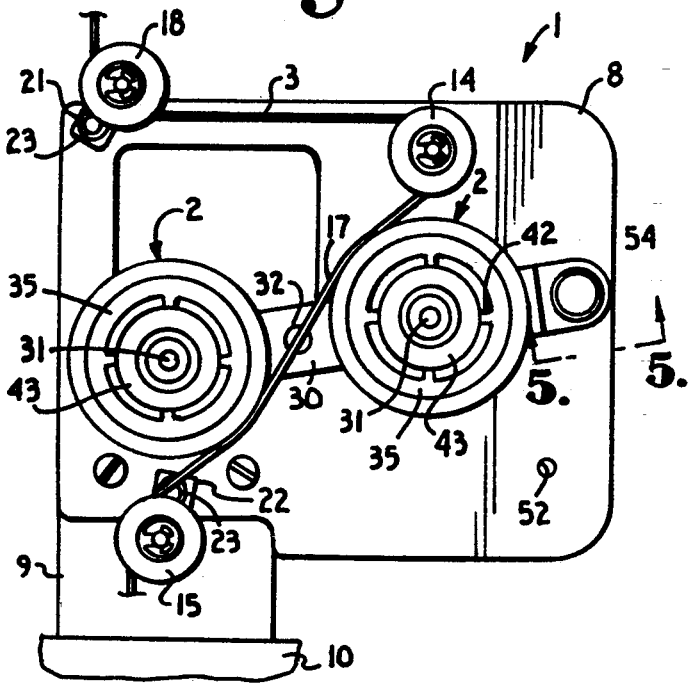
Fig. 5.
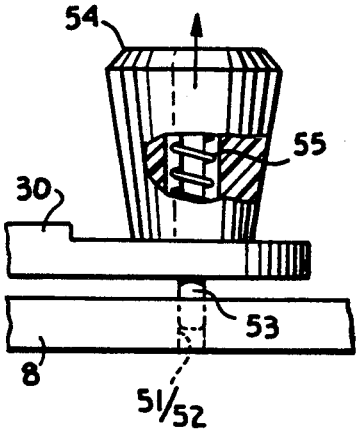
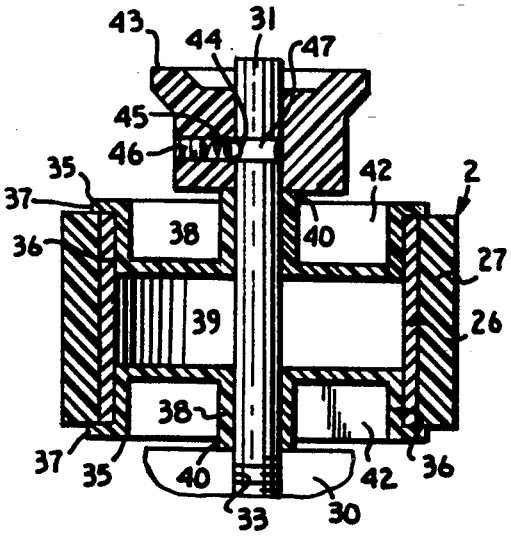
Fig. 6.
Fig. 7.
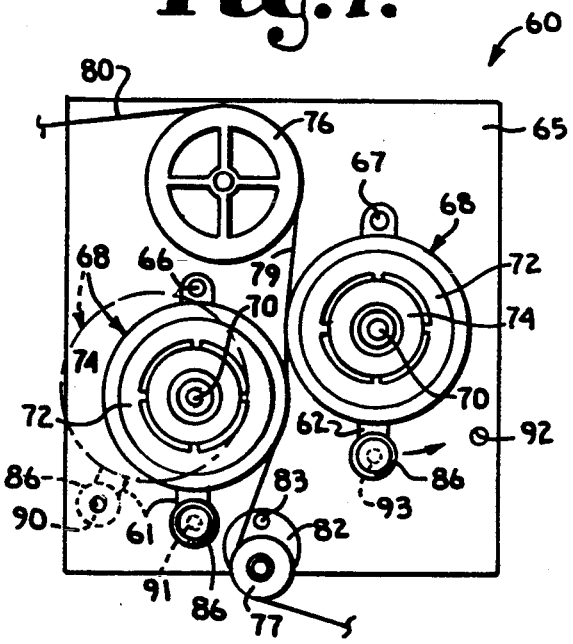

FILM STRIP CLEANER APPARATUS

BACKGROUND OF THE INVENTION

Elaborate measures are taken during the filming of motion pictures and the subsequent processing of prints thereof to produce products of the highest technical quality which the current state of the art allows. However, the film prints or films are vulnerable to a number of types of contaminants during handling and projection which can not only damage a given film and degrade the quality of the projected images thereof, but can also contaminate and damage components of the projector which can degrade the image quality of films subsequently shown on such a projector. The movement of the film base over components of film transport mechanisms in film processing and projection equipment can cause a buildup of static electricity on a film which attracts dust, lint, and the like. Additional contamination can come from lubricants within the film transport mechanisms.

The problem has long been recognized, and solutions have been proposed and implemented from the earliest days of the motion picture industry, with varying degrees of success. In one early film cleaning process, the film is transported past wicks moistened with grease solvents and afterwards past rotary brushes rotating in the opposite direction from film travel, prior to entry into a projector. In another process, the film is merely passed over rollers having cloth or felt surfaces. One problem with some of these types of film cleaning processes is that contaminants tend to build up on the cleaning media and can eventually be redeposited on the film or cause damage to the film base or emulsion thereon. In order to gradually change the cleaning surface in contact with the film strip, several process employ moving strips of cleaning fabric, past which the film is transported. Some products have been developed for neutralizing static electricity on the film strip by using a small amount of a radioactive material, such as polonium, in which radioactive decay of the material releases positively charged alpha particles to attract static electrons on the surface of the film. However, current environmental policies discourage the uncontrolled distribution of products incorporating radioactive substances.

A more modern approach involves transporting the film into contact with rollers coated with types of silicone putty to which dust, lint, greases, and other contaminants adhere. One problem with silicone putty is that it is in a semisolid state and is, thus, difficult to retain on the cleaning rollers. Current methods favor the use of a device referred to as a particle transfer roller which operates in a manner similar to the silicone putty rollers, but uses a compliant, but dimensionally stable, elastomer on an outer layer of the roller. Such rollers are manufactured by Eastman Kodak Company.

There is a limit to the amount of contaminants which the elastomeric particle transfer rollers can collect before the rollers become ineffective. However, the effectiveness of such rollers can be restored simply by washing the rollers in a mild soap, rinsing, and drying. What is needed is a film cleaner mechanism which enables the rollers to be conveniently removed for restoration of their film cleaning properties and conveniently reinstalled thereafter.

SUMMARY OF THE INVENTION

The present invention provides a film strip cleaner apparatus employing elastomeric particle transfer rollers which is configured to enable disengagement of the rollers from the film for convenient removal of the rollers for restoration of the film cleaning properties thereof. The apparatus includes a support plate which is mounted on a film projector or other film handling device. At least two film guide rollers are journaled on the support and define a film cleaning path of the film across the support plate. A roller carrying arm is pivotally mounted on the support plate and has a pair of elastomeric particle transfer rollers, or film cleaning rollers, journaled thereon at equidistant spacing from a pivot axis of the roller arm. A free end of the roller arm has a spring loaded roller arm positioning pin mounted thereon and resiliently urged toward the support plate. A knob is connected to the pin to enable operation thereof. A pair of pin receiving apertures are formed into or through the support plate and cooperate with the positioning pin to releasably fix the roller arm in either a film cleaning position or a retracted position.

In the film cleaning position, the film cleaning rollers engage opposite sides of the film traveling through the film cleaning path whereby contact with the film surfaces transfers contaminants therefrom to the surface of the elastomeric material on the film cleaning rollers. In the retracted position, the film cleaning rollers are pivoted out of contact with the film surfaces to allow removal of the film cleaning rollers for cleaning or for replacement with previously cleaned film cleaning rollers. The knob provides a handle for withdrawing the pin and for moving the roller arm between the two positions.

In a modified embodiment of the film cleaner apparatus of the present invention, a pair of elastomeric particle transfer rollers each have their own roller arm. The arms are pivotally connected to a support plate on opposite sides of a film cleaning path defined by a pair of film guide rollers. Each roller arm has a positioning pin mounted at a free end thereof, and a pair of pin receiving apertures formed into or through the support plate to place the roller either in film cleaning contact with a film strip traveling through the film cleaning path or in a retracted position to allow removal or replacement of the film cleaning roller. The film cleaning rollers engage opposite sides of the film strip to clean both sides of the film.

OBJECTS AND ADVANTAGES OF THE INVENTION

The principal objects of the present invention are: to provide an improved apparatus for cleaning motion picture film prints; to provide such an apparatus which employs elastomeric transfer rollers to remove film contaminants from the surfaces of the film by contact of the rollers with the film; to provide such an apparatus wherein the cleaning rollers can be conveniently disengaged from the moving film for removal of the rollers to restore their cleaning properties or for changeout with previously cleaned particle transfer rollers; to provide such an apparatus including a support plate for mounting on a projector or other film handling device and having at least two film guide rollers journaled thereon to define a film cleaning path across the support plate; to provide such an apparatus including a cleaning roller mounting arm which is pivotally connected to the support plate and has a pair of particle transfer or film cleaning rollers journaled thereon in spaced relation to a pivot axis of the roller arm and positioned on opposite sides of the film cleaning path; to provide such an apparatus wherein the support plate has a pair of roller positioning apertures including a film cleaning aperture and a retracted aperture and the roller arm has a spring loaded positioning pin for reception in the apertures to position the roller arm respectively in a film cleaning position with the film cleaning rollers engaging opposite sides of the film in the film cleaning path or a retracted position with the cleaning rollers retracted out of contact with the film to enable convenient removal of the rollers from the roller arm for cleaning; to provide such an apparatus wherein the roller arm includes a pin release knob to resiliently withdraw the positioning pin from the apertures and to facilitate pivoting the roller arm between the two positions; to provide a modified embodiment of the film cleaning apparatus including a pair of roller mounting arms pivotally mounted on opposite sides of a film cleaning path, each roller arm having a particle transfer or film cleaning roller journaled thereon; to provide such a modified embodiment wherein a pair of roller arm positioning apertures is associated with each roller arm and roller, the free end of each roller arm having a spring loaded roller arm positioning pin mounted therein and a pin release knob; to provide such film cleaning apparatus which can be retrofitted to existing types of commercial film projectors; and to provide such film strip cleaning apparatus which are economical to manufacture, which are convenient and effective in operation, and which are particularly well adapted for their intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 3 is a view similar to FIG. 2 and illustrates the roller carrying arm in an engaged or cleaning position with the film rollers engaged with the film.

FIG. 5 is an enlarged side elevational view taken on line 5—5 of FIG. 3 and illustrates details of a position lock pin of the apparatus.

FIG. 6 is an enlarged diametric sectional view taken on line 6—6 of FIG. 2 and illustrates details of the film cleaner roller assemblies.

FIG. 7 is a side elevational view of a modified embodiment of the film strip cleaner apparatus employing individual film cleaner roller carrying arms.

DETAILED DESCRIPTION OF THE INVENTION

Figure 1:
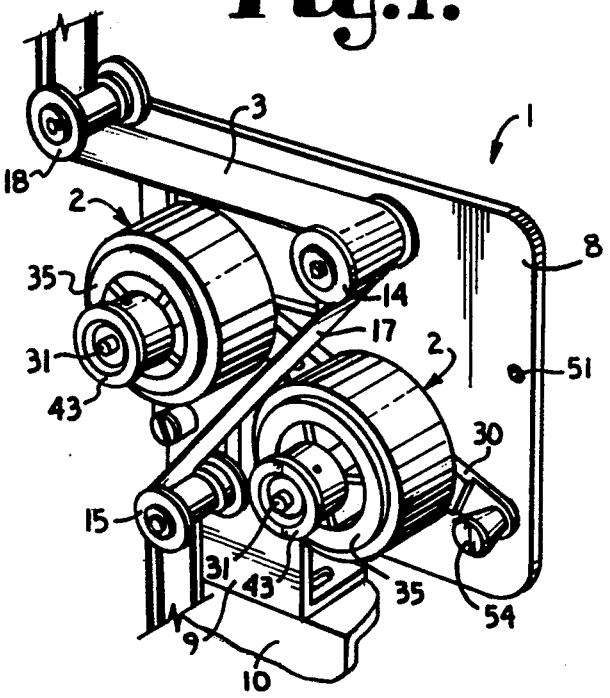
FIG. 1 is a fragmentary perspective view illustrating a film strip cleaner apparatus embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a film strip cleaner apparatus which embodies the present invention. The apparatus 1 generally includes a pair of film cleaner rollers 2 which are engaged with a film strip 3 to clean contaminants from the film 3 and disengaged from the film 3 for removal of the cleaning rollers 2 to allow cleaning of the rollers 2 to restore their film cleaning properties.

Figure 2:
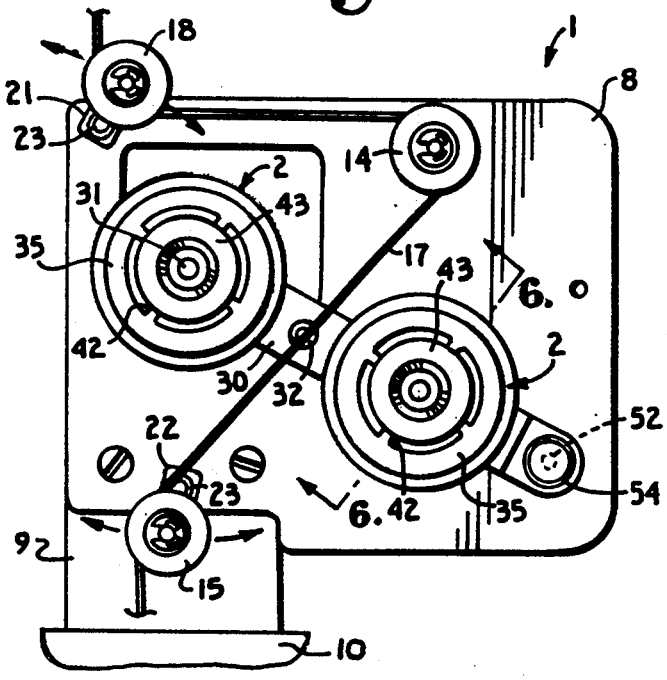
FIG. 2 is a fragmentary side elevational view of the film strip cleaner apparatus and illustrates a roller carrying arm thereof in a retracted position with film cleaner rollers retracted from contact with the film.

The apparatus 1 includes a rectangular support plate 8 which is stationarily mounted by a bracket 9 on a motion picture projector 10 or other film handling device. A pair of flanged film guide rollers, 14 and 15 are journaled on the support plate 8 and are engaged by the motion picture print or film strip 3 to define a cleaning run or path 17 of the film 3 between the guide rollers 14 and 15. A third flanged film guide roller 18 may also be journaled on the support plate 8 to guide the film 3 as needed. The illustrated input guide roller 18 and the output roller 15 are journaled on respective radial arms 21 and 22 (FIG. 2). The radial arms 21 and 22 can be angularly adjusted and fixed in position by fasteners 23 to accommodate the relative positioning of the apparatus 1 to a film entry location of the projector 10 and a film supply reel (not shown) or other device feeding the film 3 to the projector 10. The intermediate guide roller 14 may be journaled directly on the support plate 8.

Each of the film cleaning rollers 2 includes a cylindrical roller rim 26 (FIG. 6) formed of aluminum and an outer layer 27 formed of a compliant elastomer which has the capability of picking up not only dust and lint, but also contaminants such as lubricants from film handling mechanisms, such as the projector 10, and skin oils such as finger prints from the surfaces of the film 3 by contact therewith. The rollers 2 are manufactured by Eastman Kodak Company and are known as "PTR" or particle transfer rollers. When an amount of contaminants has accumulated On the surfaces of the rollers 2 such that they are no longer effective in removing further contaminants, their film cleaning capabilities can be restored by washing in a mild soap, rinsing, and drying. The rollers 2 are available in sizes suitable for both 35 and 70 millimeter film formats.

Figure 4:
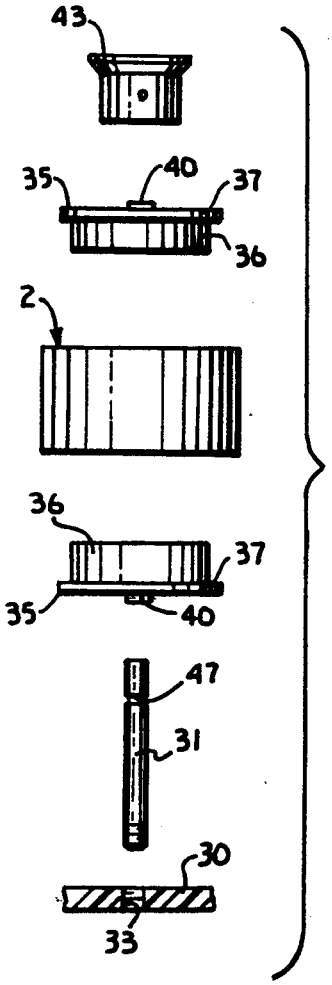
FIG. 4 is an exploded side elevational view and illustrates details of components of the film cleaner roller assemblies.

In the illustrated apparatus 1, the film cleaning rollers 2 are journaled on an elongated roller carrying arm or lever 30 which is pivotally connected to the support plate 8. Rotational axes for the rollers 2 are formed by spindles 31 extending perpendicularly from the roller arm 30 and are located equidistant from a pivot axis of the roller arm 30 formed by a pivot fastener 32. The spindles 31 may be affixed to the roller arm 30 as by threaded reception in bores 33 (FIG. 4) formed through the arm 30. The roller arm 30 is mounted on the support plate 8 at such a position that the pivot axis formed by the fastener 32 substantially aligns with the film 3 in the cleaning path 17 and with the spindles 31 and, thus the rollers 2, positioned on opposite sides of the film 3 in the cleaning path 17.

Each of the illustrated rollers 2 is rotatably mounted on a respective spindle 31 by a pair of roller mounting hubs 35 (FIGS. 4 and 6) which have cylindrical walls 36 sized to fit within the inner rims 26 of the rollers 2 and outer flanges 37 which engage side surfaces of the rollers 2. A central bearing core 38 of each hub 35 has a rotary bearing bore 39 formed therethrough. An extension 40 of the bearing core 38 extends axially beyond the outer plane of the flange 37 and functions as a thrust bearing for the hub 35. The illustrated hubs 35 have inner walls or webs 41 and radial ribs 42 which connect the bearing cores 38 with the cylindrical walls 36.

A pair of the hubs 35 have the cylindrical walls 36 thereof inserted into the rim 26 of a roller 2, and the roller assembly is mounted on a spindle 31 which extends through the aligned bores 39 thereof. The assembly is retained on the spindle 31 by a snap-on retainer 43 formed by a collar having a detent ball 44 resiliently urged inwardly by a spring 45 which is compressed by a set screw 46 to engage a circumferential groove 47 formed in the surface of the spindle 31. The groove 47 and the thrust extensions 40 are respectively positioned and sized to align the film cleaning rollers 2 with the film guide rollers 14, 15, and 18.

The illustrated film cleaner rollers 2 are capable of two fixed positions, an engaged or cleaning position illustrated in FIG. 3 with the rollers 2 engaging the film 3 in the cleaning path 17 and a retracted position shown in FIGS. 1 and 2 with the rollers 2 retracted from the film 3. For this purpose, the support plate 8 has an engaged or cleaning aperture 51 and a retracted aperture 52 formed therein or thereinto and a retractable position locking pin 53 (FIG. 5) mounted on the roller arm 30. A knob 54 is connected to the pin 53, and the knob 54 and pin 53 are resiliently urged toward the support plate 8 by a spring 55. The knob 54 provides a means for withdrawing the pin 53 from the apertures 51 and 52 and for pivoting the roller arm 2 between the engaged position and the retracted position.

The apparatus 1 provides a convenient mechanism for disengaging the cleaning rollers 2 from the film 3 in the cleaning path 17 whenever it is necessary to remove or changeout the rollers 2. Since it is often necessary to change the rollers 2 during operation of the projector 10 and because the linear speed of the film 3 travelling through the cleaning path 17 is relatively high, up to almost 50 inches per second depending on the film format, it is desirable to avoid contact with the moving film 3 to avoid possible injury or damage to the film 3. In the retracted position of the roller arm 30, the rollers 2 are completely disengaged from the film 3 whereby the rollers 2 can be removed with relative safety to the projectionist and the film 3.

While the apparatus 1 has been described in terms of only using one film cleaning apparatus 1 per projector 10, it should be understood that a second apparatus 1 could also be installed on a projector 10 whereby the cleaning rollers 2 of a first apparatus 1 are engaged prior to disengaging the rollers 2 of a second apparatus 1 so that the film 3 is at all times engaging at least one set of the cleaning rollers 2 prior to entering the projector 10.

FIG. 7 illustrates a modified embodiment 60 of the film cleaning apparatus according to the present invention. In the two arm film cleaning apparatus 60, a pair of roller carrying arms 61 and 62 are pivotally connected to a support plate 65 by a respective pivot fastener 6667. Each arm 61 and 62 has a particle transfer or film cleaning roller 68 journaled thereof. The cleaning rollers 68 are mounted on the roller arms 61 and 62 in a manner similar to the mounting of the rollers 2 of the apparatus 1 on the roller arm 30. Each roller arm 61 or 62 has a spindle 70 attached perpendicular thereto. Each roller 68 has a pair of back to back hub members 72 received therein to form rotary bearings for the rollers 68 to rotate on the spindles 70. The rollers 68 are retained on the spindles 70 by snap-on retainers 74 similar to the retainers 43 of the apparatus 1.

A pair of film guide rollers 76 and 77 are journaled on the support plate 65 and define a cleaning path 79 therebetween through which a film strip 80 passes. At least one of the film guide rollers, such as the lower roller 77, is journaled on a radial arm 82 which is angularly adjustable relative to the support plate 65 and fixed into place by a fastener 83.

Each roller arm 61 and 62 has a knob 86 connected to an arm position locking pin (not shown) similar to the lock pin 53 of the apparatus 1. A pair of pin receiving apertures 90 and 91 are formed in the support plate 65 to receive the lock pin of the arm 61 in respectively a retracted position using the aperture 90 or an engaged or cleaning position using the aperture 91. Similarly, a retracted aperture 92 and an engaged aperture 93 are formed in the support plate 65 to receive the lock pin of the arm 62 in respectively a retracted position or an engaged position. The knobs 86 and lock pins are resiliently urged toward the support plate 65 and are similar to the knob 54 and pin 53 of the apparatus 1.

The roller arms 61 and 62 are moved independently into their engaged positions to engage the rollers 68 with opposite sides of the film 80 in the cleaning path 79 or into their retracted positions to enable removal of the cleaning rollers 68 to restore their cleaning properties. In other respects, the two arm film cleaner apparatus 60 is substantially similar to the one arm film cleaner apparatus 1 described above.

It is to be understood that while certain forms of the present invention have been illustrated and described herein, it is not to be limited to the specific forms or arrangement of parts described and shown.

What is claimed and desired to be secured by Letters Patent is as follows:

1. A film strip cleaner apparatus comprising:

(a) stationary support means;

(b) film strip transport means mounted on said support means to define a cleaning path of a film strip across said support means;

(c) a roller arm pivotally mounted on said support means;

(d) a first film strip cleaning roller rotatably mounted on said arm;

(e) a second film strip cleaning roller rotatably mounted on said arm in spaced relation to the first roller;

(f) cooperating roller position means on said support means and said arm to positively position said arm at a film engaging position to engage said rollers with said film strip in said cleaning path and to positively position said arm at a retracted position with said rollers out of contact with said film strip; and (g) said arm being pivotally connected to said support means at a position intermediate the rollers whereby said rollers contact opposite sides of said film strip in said film engaging position.

2. An apparatus as set forth in claim 1 wherein:

(a) said roller is rotatably mounted on said roller arm by removable roller retainer means to facilitate removal of said roller from said roller arm for cleaning said roller.

3. An apparatus as set forth in claim 1 and including:

(a) grip means on said arm to enable manual grasping thereof to facilitate moving said arm between said positions.

4. An apparatus as set forth in claim 1 wherein said roller positioning means includes:

(a) a position lock pin resiliently mounted on said roller arm and resiliently urged toward said support means;

(b) a film engaging aperture formed into said support means to receive said pin in said film engaging position of said roller arm; and (c) a retracted aperture formed into said support means to receive said pin in said retracted position of said roller arm.

5. An apparatus as set forth in claim 4 and including:

(a) a knob connected to said pin to enable resilient withdrawal of said pin from said apertures for movement of said roller arm between said positions.

6. A film strip cleaner apparatus comprising:

(a) a film cleaner support plate adapted for stationary mounting;

(b) film strip transport means mounted on said support plate to define a cleaning path of a film strip across said support plate;

(c) a roller arm pivotally mounted on said support plate to enable pivoting about a pivot axis;

(d) a pair of film strip cleaning rollers rotatably mounted on said roller arm in spaced apart relation at substantially equal distances from said pivot axis; and (e) cooperating roller position means on said support plate and said arm to positively position said arm at a film engaging position to engage said rollers with opposite sides of said film strip in said cleaning path and to positively position said arm at a retracted position with said rollers out of contact with said film strip.

7. An apparatus as set forth in claim 6 wherein:

(a) each of said rollers is rotatably mounted on said roller arm by removable roller retainer means to facilitate removal of said rollers from said roller arm for cleaning said rollers.

8. An apparatus as set forth in claim 6 and including:

(a) grip means on said arm to enable manual grasping thereof to facilitate moving said arm between said positions.

9. An apparatus as set forth in claim 6 wherein said roller positioning means includes:

(a) a position lock pin mounted on said roller arm and resiliently urged toward said support plate;

(b) a film engaging aperture formed into said, support plate to receive said pin in said film engaging position of said roller arm; and (c) a retracted aperture formed into said support plate to receive said pin in said retracted position of said roller arm.

10. An apparatus as set forth in claim 9 and including:

(a) a knob connected to said pin to enable resilient withdrawal of said pin from said apertures for movement of said roller arm between said positions.

11. An apparatus as set forth in claim 6 wherein said film transport means includes:

(a) a pair of spaced apart film transport rollers rotatably mounted on said support plate and positioned to define said cleaning path of said film strip.

12. An apparatus as set forth in claim 11 and including:

(a) at least one of said film transport rollers being rotatably mounted on a radial arm which is pivotally connected to said support plate to enable variation of the position of said one film transport roller; and (b) fixing means engaged between said radial arm and said support plate to releasably fix the position of said radial arm relative to said support plate.

13. A film strip cleaner apparatus comprising:

(a) a film cleaner support plate adapted for stationary mounting;

(b) a first and a second film guide rollers rotatably mounted on said support plate to define a cleaning path therebetween;

(c) a film clean roller arm pivotally mounted on said support plate to enable pivoting about a pivot axis;

(d) a pair of film strip cleaning rollers rotatably mounted on said roller arm in spaced apart relation at substantially equal distances from said pivot axis;

(e) a position lock pin mounted on said roller arm and resiliently urged toward said support plate;

(f) a film engaging aperture formed into said support plate to receive said pin in a film engaging position of said roller arm to engage said film clean rollers with opposite sides of said film strip in said cleaning path; and (g) a retracted aperture formed into said support plate to receive said pin in a retracted position of said roller arm to retract said rollers from said film strip.

14. An apparatus as set forth in 13 and including:

(a) at least one of said film guide rollers being rotatably mounted on a radial arm which is pivotally connected to said support plate to enable variation of the position of said one film guide roller; and (b) fixing means engaged between said radial arm and said support plate to releasably fix the position of said radial arm relative to said support plate.

15. An apparatus as set forth in claim 13 wherein:

(a) each of said film clean rollers is rotatably mounted on said roller arm by removable roller retainer means to facilitate removal of said film clean rollers from said roller arm.

16. An apparatus as set forth in claim 13 and including:

(a) a knob connected to said pin to enable resilient withdrawal of said pin from said apertures for movement of said roller arm between said positions.

17. A film strip cleaner apparatus comprising:

(a) stationary support means;

(b) film strip transport means mounted on said support means to define a cleaning path of a film strip across said support means;

(c) a roller arm pivotally mounted on said support, means;

(d) a film strip cleaning roller rotatably mounted on said arm;

(e) cooperating roller position means on said support means and said arm to positively position said arm at a film engaging position to engage said roller with said film strip in said cleaning path and to positively position said arm at a retracted position with said roller out of contact with said film strip;

(f) said film transport roller being rotatably mounted on a radial arm which is pivotally connected to said support means to enable variation of the position of said film transport roller; and (g) fixing means engaged between said radial arm and said support means to releasably fix the position of said radial arm relative to said support means.

* * * * *